US006845641B2

(12) United States Patent
Hsieh

(10) Patent No.: US 6,845,641 B2
(45) Date of Patent: Jan. 25, 2005

(54) REMOTE-CONTROLLED DOOR LOCK

(76) Inventor: Hui-Hua Hsieh, P.O. Box 90, Tainan City (TW)

( * ) Notice: Subject to any disclaimer, the term of this patent is extended or adjusted under 35 U.S.C. 154(b) by 365 days.

(21) Appl. No.: 10/209,881

(22) Filed: Aug. 2, 2002

(65) Prior Publication Data

US 2004/0021553 A1 Feb. 5, 2004

(51) Int. Cl.[7] ..... E05B 65/12
(52) U.S. Cl. ..... 70/257; 70/150; 70/275
(58) Field of Search ..... 70/256, 257, 150, 70/151 R, 275; 292/144

(56) References Cited

U.S. PATENT DOCUMENTS 4,262,504 A * 4/1981 Inoue ..... 70/151 R
4,866,963 A * 9/1989 Leininger et al. ..... 70/278.2
6,619,085 B1 * 9/2003 Hsieh ..... 70/257
6,644,072 B1 * 11/2003 Hsieh ..... 70/107
6,658,905 B1 * 12/2003 Hsieh ..... 70/279.1
6,666,054 B1 * 12/2003 Hsieh ..... 70/257
6,698,263 B2 * 3/2004 Hsieh ..... 70/257

* cited by examiner

*Primary Examiner*—John B. Walsh

(57) ABSTRACT

A remote-controlled door lock includes a housing provided inside with a lock base, a deadbolt, a battery base, a circuit board and an actuating device. The deadbolt is fixed with a stopper on the center portion. The locking button of a remote controller is pressed to send out a locking signal to the circuit board to start the motor of the actuating device to rotate. Synchronously, the rotating shaft of the motor actuates a rotary member to rotate together with its notch, which rotates to reach the stopper of the deadbolt and holds the stopper immovable therein, rendering the deadbolt unable to be moved inward. Thus even if the lock rods of the lock base are pried unlocked, the door lock is still impossible to be unlocked before the actuating device is driven by a remote controller to release the deadbolt, having best effect of anti-theft.

1 Claim, 4 Drawing Sheets

REMOTE-CONTROLLED DOOR LOCK

BACKGROUND OF THE INVENTION

1. Field of the Invention

This invention relates to a remote-controlled door lock, particularly to one able to be locked only by pressing the locking button of a remote controller, which sends out a locking signal to a circuit board to start the motor of an actuating device to rotate. Synchronously, the motor has its rotating shaft actuate a rotary member to rotate together with its notch, which rotates to reach the stopper of a deadbolt and firmly holds the stopper therein, making the deadbolt unable to be moved inward. Thus, even if the lock rods of a lock base are pried unlocked, the door lock is still impossible to be unlocked unless the actuating device is driven by a remote controller to release the deadbolt, having best effect of anti-theft.

2. Description of the Prior Art

A conventional door lock, as shown in FIG. 1, includes a housing 10 installed inside with a lock base 11 provided at one side with lock rods 110 able to extend out of the through holes 100 in the sidewall of the housing 10. The lock base 11 has a lock core 111 with a keyhole 112 provided respectively at the inner and the outer side. A pull plate 12 has its front portion inserted in one side of the housing 10, having a fixing plate 120 inserted in the slide hole 101 of the housing 10 and abutting against the fixing plate 102 of the housing 10. In addition, the housing 10 is fitted inside with a deadbolt 13 having one end inserted through the fixing plate 102 of the housing 10 and secured with the fixing plate 120 of the pull plate 12, with a spring 130 fitted around the inner end of the deadbolt 13 near the fixing plate 102, and the other end fixed with a stopper 131 able to extend out of the through hole 103 in the sidewall of the housing 10. Thus, when a key is inserted in the keyhole 112 of the lock core 111 and turned around to actuate the lock rods 110 and the stopper 131 to move inward toward the housing 10, the door lock can be unlocked.

However, the conventional door lock has its lock rods 110 locked simply by a key, therefore it can easily be pried unlocked by certain unlocking tools, having hardly any effect of anti-theft.

SUMMARY OF THE INVENTION

The objective of this invention is to offer a remote-controlled door lock having best effect of anti-theft.

The feature of the invention is that a housing is installed inside with a battery base, a circuit board and an actuating device. The actuating device is provided with a motor having its rotating shaft fitted with a rotary member having a helical surface at one end and a notch therein. The housing is further fitted inside with a deadbolt having a stopper fixed thereon.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
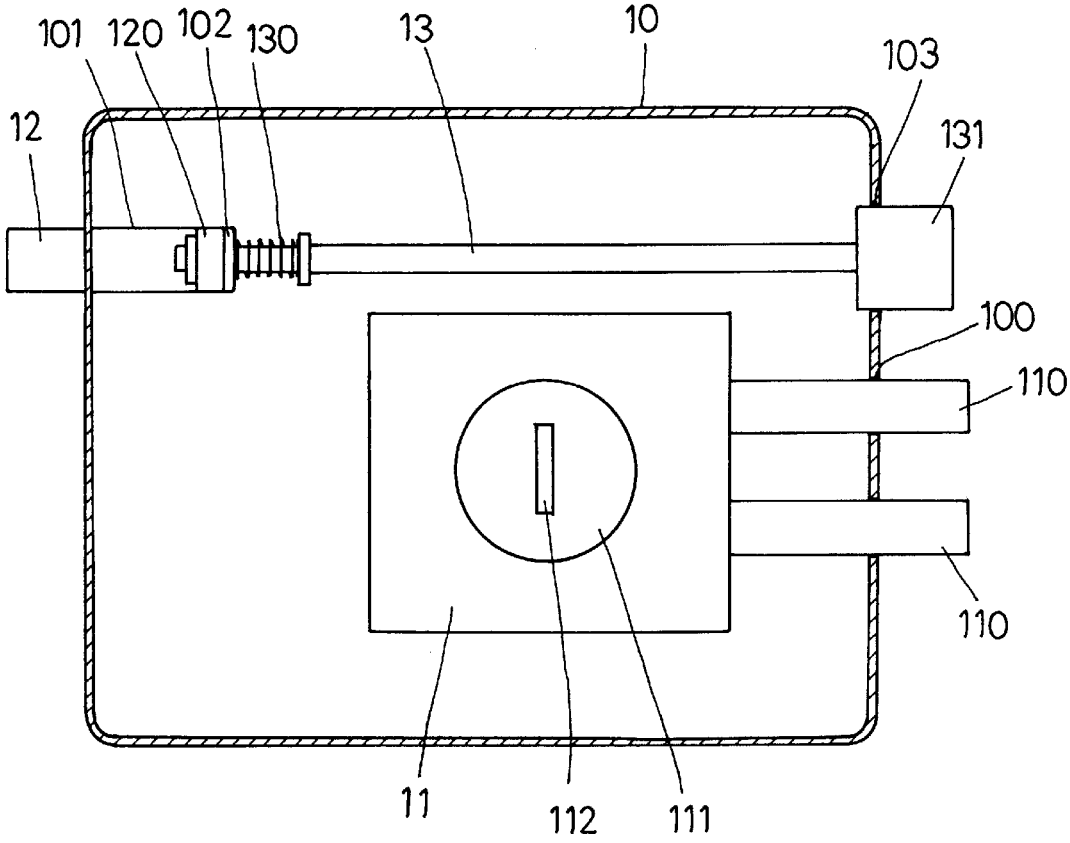
FIG.1 (PRIOR ART)
FIG. 1 is a front view of a conventional door lock.
Figure 2:
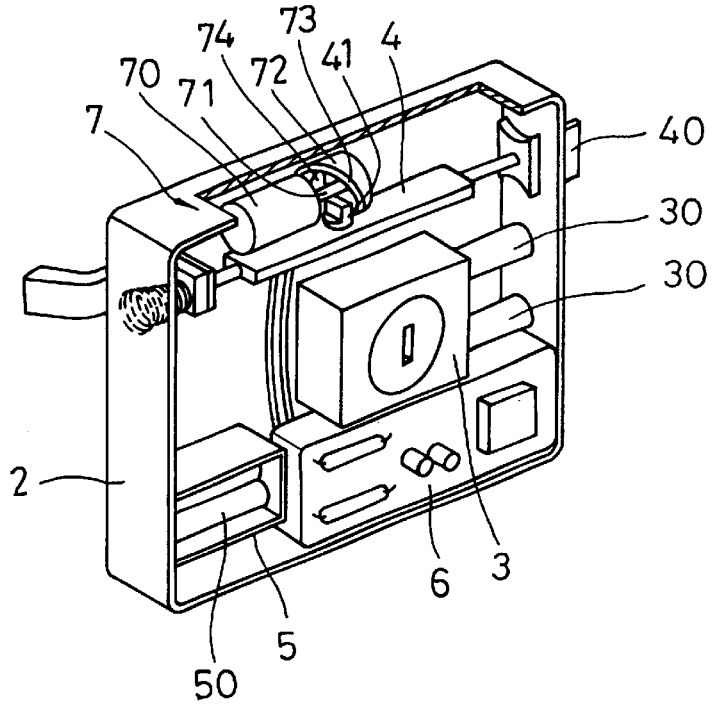
FIG. 2 is a perspective view of the interior of a remote-controlled door lock in the present invention.
Figure 3:
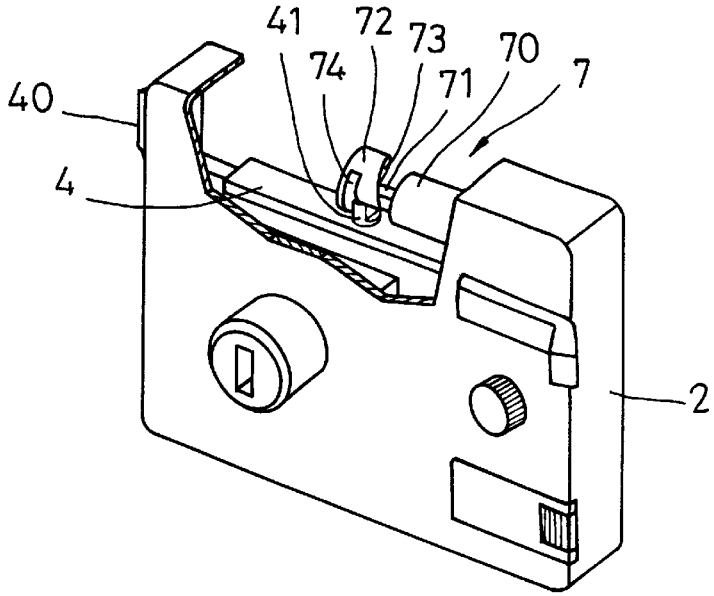
FIG. 3 is a cross-sectional and perspective view of the exterior of the remote-controlled door lock in the present invention.

A preferred embodiment of a remote controlled door lock in the present invention, as shown in FIGS. 2 and 3, includes a housing 2, a lock base 3 installed inside the housing 2, a deadbolt 4, a battery base 5, a circuit board 6 and an actuating device 7.

The lock base 3 is provided with lock rods 30 able to extend out of a sidewall of the housing 2. The deadbolt 4 has one end fixed with a block 40 able to extend out of the sidewall of the housing 2 and has a stopper 41 secured on a central portion. The battery base 5 is fitted therein with a battery 50. The actuating device 7 is positioned on the deadbolt 4, having a motor 70. The motor 70 has its rotating shaft 71 provided thereon with a rotary member 72 having a helical surface 73 at one end and a notch 74 therein.

Figure 4:
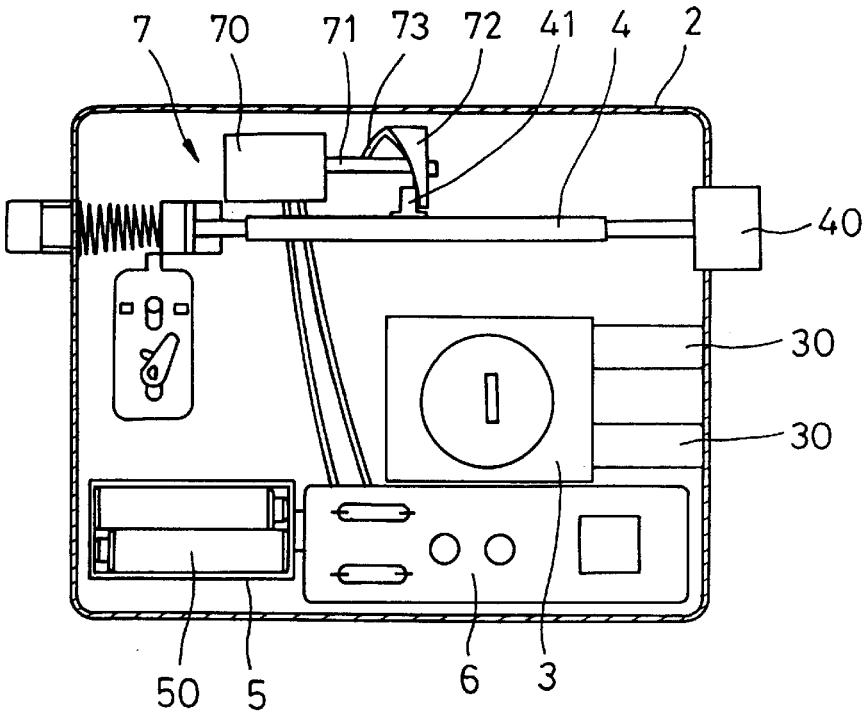
FIG. 4 is a cross-sectional view of the remote-controlled door lock in a normal condition in the present invention.
Figure 5:
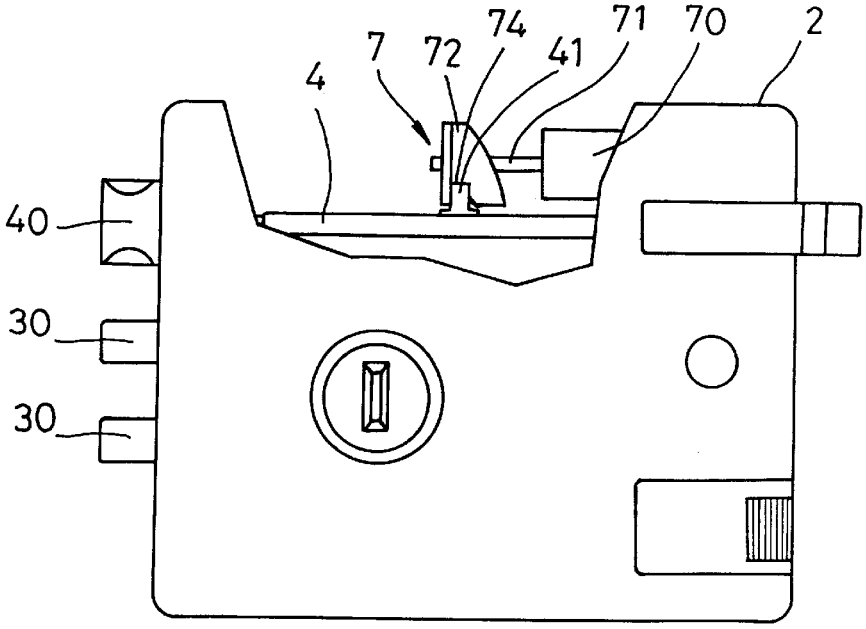
FIG. 5 is a cross-sectional view of the remote-controlled door lock locked by a remote controller in the present invention; and, FIG. 6 is a cross-sectional view of the remote-controlled door lock unlocked by a remote controller in the present invention.

To lock the door lock, as shown in FIGS. 4 and 5, a key is inserted in the lock base 3 and turned around to make the lock rods 30 of the lock base 3 extend outward and inserted in the engage holes of a door jamb. Then, press the locking button of a remote controller to send out a locking signal to the circuit board 6 to start the motor 70 of the actuating device 7 to rotate, and synchronously the rotating shaft 71 of the motor 70 actuates the rotary member 72 and the notch 74 to rotate counterclockwise. When the notch 74 of the rotary member 72 rotates and reaches the stopper 41 of the deadbolt 4, the stopper 41 will be retained immovable in the notch 74 and hence the deadbolt 4 cannot be moved inward. Thus, even though the lock rods 30 of the lock base 3 are pried unlocked, the door lock is still impossible to be unlocked before the actuating device 7 is driven by a remote controller to release the deadbolt 4, achieving best effect of anti-theft.

Figure 6:
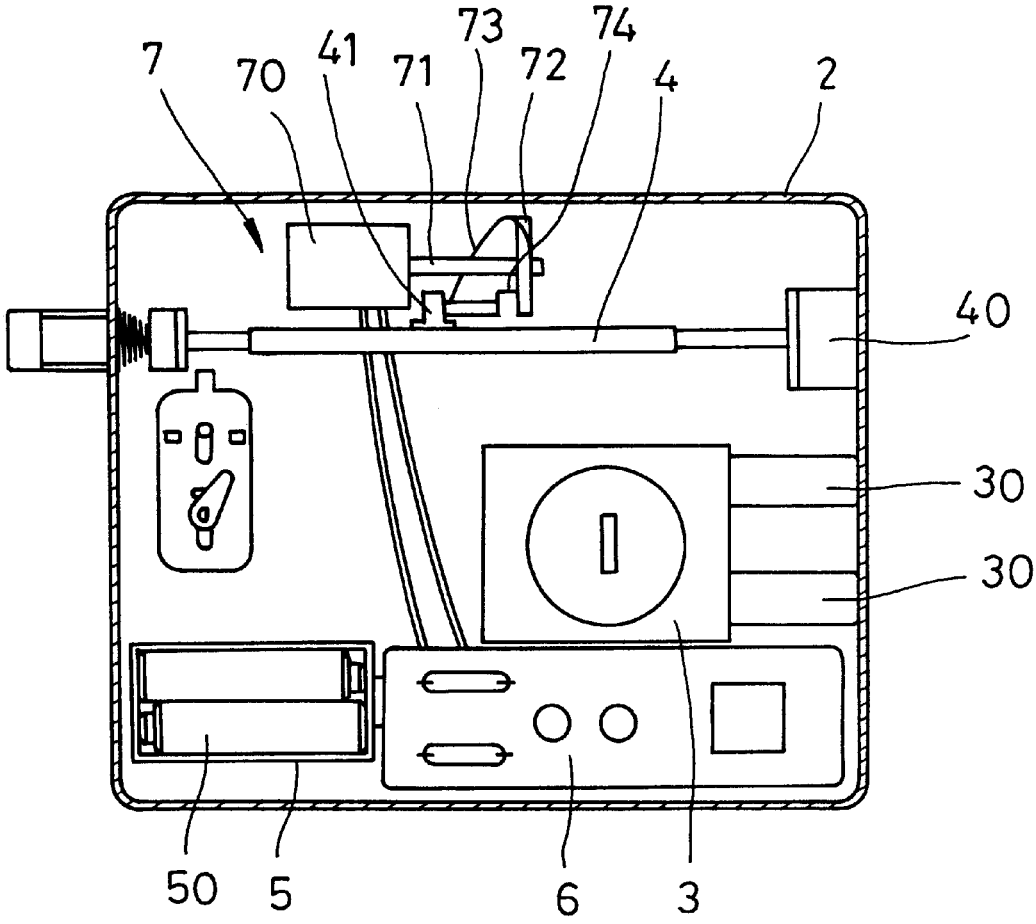

To unlock the door lock, as shown in FIGS. 4 and 6, simply press the unlocking button of a remote controller to give out an unlocking signal to the circuit board 7 to start the motor 70 of the actuating device 7 to rotate to have its rotating shaft 71 actuate the rotary member 72 to rotate clockwise. Simultaneously, the notch 74 of the rotary member 72 rotates and disengages from the stopper 41 of the deadbolt 4, and at this time the stopper 41 of the deadbolt 4 moves along the helical surface 73 of the rotary member 72 and pushes the deadbolt 4 to shift inward. Then, a key is inserted in the lock base 3 and turned around to make the lock rods 30 of the lock base 3 disengaged from the engage holes of a door jamb to finish unlocking of the door lock.

While the preferred embodiment of the invention has been described above, it will be recognized and understood that various modifications may be made therein and the appended claims are intended to cover all such modifications that may fall within the spirit and scope of the invention.

What is claimed is:

1. A remote-controlled door lock comprising a housing, said housing installed inside with a lock base and a deadbolt, said lock base provided with at least one lock rod, said lock rod able to extend out of the sidewall of said housing, said deadbolt having one end fixed with a block, said block able to extend out of said sidewall of said housing; and, characterized by said housing provided with a battery base, a circuit board and an actuating device in its interior, said actuating device having a motor, said motor having its rotating shaft fixed with a rotary member, said rotary member having one end provided with a helical surface, said rotary member bored with a notch, said deadbolt having a stopper fixed on a central portion, a locking button of a remote controller pressed to send out a locking signal, said circuit board receiving said locking signal and starting said motor of said actuating device to rotate, said rotating shaft of said motor forcing said rotary member to rotate, said notch rotating together with said rotary member, said notch rotating and reaching said stopper of said deadbolt, said stopper held immovable by said notch of said rotary member to stop said deadbolt from being moved inward, the door lock impossible to be unlocked even through said lock rods of said lock base are pried unlocked, said door lock possible to be unlocked only when said actuating device is driven by a remote controller to release said deadbolt, obtaining best effect of anti-theft.

* * * * *